US005957706A

United States Patent [19]

Phillips, Jr. et al.

[11] Patent Number: 5,957,706

[45] Date of Patent: Sep. 28, 1999

[54] IGNITION CABLE TERMINAL ASSEMBLY

[75] Inventors: William Thomas Phillips, Jr., Boardman; Lawrence Gene Pelanda, Canfield, both of Ohio

[73] Assignee: General Motors Corporation, Detroit, Mich.

[21] Appl. No.: 09/098,768

[22] Filed: Jun. 17, 1998

[51] Int. Cl.[6] ..... H01R 13/44

[52] U.S. Cl. ..... 439/127

[58] Field of Search ..... 439/125, 126, 439/127, 128

[56] References Cited

U.S. PATENT DOCUMENTS 5,618,193 4/1997 Nakajima ..... 439/125

*Primary Examiner*—Steven L. Stephan
*Assistant Examiner*—Javaid Nasri
*Attorney, Agent, or Firm*—Cary W. Brooks; Patrick M. Griffin

[57] ABSTRACT

An ignition cable terminal assembly connects an ignition cable to a stud terminal of a spark plug. The assembly includes a metal sleeve that has a crimp barrel at an upper end, an intermediate compression ring, a lead-in below the compression ring and an inwardly directed stop ring below the lead-in. A lock sleeve inside the metal sleeve, has a plurality of spaced longitudinal channels in an inner cylindrical surface that communicate with an annular cavity at an upper end. The longitudinal channels include lock channels that have lock ledges at the cavity and release channels between the lock channels. Upper and lower ring gears are inside the lock sleeve. The lower ring gear engages the top of the stud terminal and has radial teeth that slide in the channels of the lock sleeve. The lower ring gear also carries a plurality of circumferentially spaced, cantilevered, spring contact arms that extend below the bottom of the lower ring gear for establishing an electrical connection between the metal sleeve and the stud terminal of the spark plug. The upper ring gear has radial teeth that slide in the release channels and index into engagement with the lock ledges to lock the terminal assembly to the spark plug. The upper ring gear has ramps engaging ramps of the lower ring gear for indexing. A spring biases the upper and lower ring gears downwardly. The ring gears recede into the lock sleeve and index the upper ring gear into engagement with the lock ledges to lock the spring contact arms into tight engagement with the stud terminal when the ignition cable assembly is pushed down onto the stud terminal.

9 Claims, 3 Drawing Sheets

IGNITION CABLE TERMINAL ASSEMBLY

TECHNICAL FIELD

This invention relates generally to electric cable terminals and, more particularly, to an ignition cable terminal assembly for connecting an ignition cable to a stud terminal of a spark plug or the like.

GROUND OF THE INVENTION

U.S. Pat. No. 4,009,924 granted to Edward M. Bungo and Lloyd D. Jack on Mar. 1, 1977, discloses a typical ignition cable terminal assembly for connecting an ignition cable to a spark plug stud terminal. This ignition cable terminal assembly comprises a sheet metal terminal having a forward sleeve and a spring clip that embraces the forward portion of the sleeve. The sleeve is plugged onto the spark plug stud terminal and dimples of the spring clip biasingly engage the spark plug stud terminal to make the electrical connection.

This general type of ignition cable terminal assembly has been used successfully in one form or another for several years. However, in recent years the United States Government has mandated onboard diagnostic systems for automobiles which require a very precise electrical connection of the ignition cable to the spark plug terminal. Generally, ignition cable terminal assemblies can meet such a requirement by making a very tight, motion free, mechanical connection to the spark plug terminal in order to avoid any possibility of microarching that might create a false signal to the onboard engine computer. However, such mechanical connections create ancillary problems, such as high terminal engagement and disengagement force requirements and the possibility of poor electrical connections if the ignition cable terminal assembly is not plugged onto the spark plug with sufficient force.

SUMMARY OF THE INVENTION

The object of this invention is to provide an ignition cable terminal assembly that has a very tight mechanical fit with the stud terminal of the spark plug yet does not require either a high terminal engagement force or a high terminal disengagement force.

A feature of the invention is that the ignition cable terminal assembly has a contractible socket that freely receives the stud terminal and then is automatically closed down into tight engagement with the stud terminal as the ignition cable terminal assembly is pushed onto the stud terminal of the spark plug.

Another feature of the invention is that the ignition cable terminal assembly has a contractible socket formed by a plurality of cantilevered spring arms that are cammed radially inwardly into tight engagement with the stud terminal as the ignition cable terminal assembly is pushed down onto the stud terminal of the spark plug.

Still another feature of the invention is that the ignition cable terminal assembly has a contractible socket that tightly engages the stud terminal yet does not require a high pull-off force to disconnect the terminal assembly from the spark plug.

Yet another feature of the invention is that the ignition cable terminal assembly has a plurality of cantilevered spring arms tightly engaging the stud terminal that are automatically spread apart to reduce the force required to disconnect the terminal assembly from the spark plug.

Still yet another feature of the invention is that the ignition cable terminal assembly has a contractible socket comprising spring arms that spread apart under self biasing forces when the terminal assembly is disconnected from the stud terminal to reduce the force required for terminal disengagement.

Still yet another feature of the invention is that the ignition cable terminal assembly has a contractible socket that is released by pushing down on the terminal assembly thereby reducing the force required for terminal disengagement substantially.

These and other objects, features and advantages of the invention will become apparent from the description below, which is given by way of example with reference to the accompanying drawings.

DESCRIPTION OF THE PREFERRED EMBODIMENT

Figure 1:
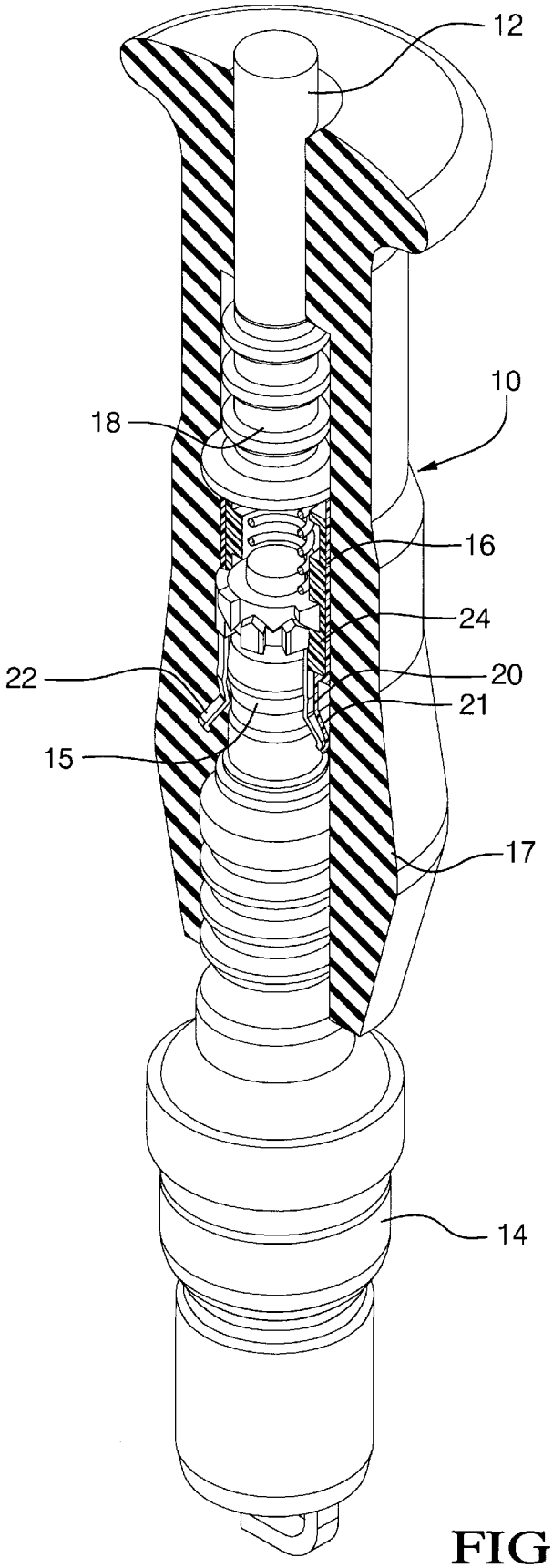
FIG. 1 is a partially sectioned, perspective view of an ignition cable installation having an ignition cable terminal assembly of the invention showing the ignition cable terminal assembly in the process of being connected to the stud terminal of a spark plug.

Referring to FIG. 1, an ignition cable terminal assembly 10 is attached to the end of an ignition cable 12 for connecting ignition cable 12 to a spark plug 14.

Ignition cable terminal assembly 10 comprises a metal sleeve 16 housed in an insulation boot 17 of synthetic rubber or other suitable material. Sleeve 16 has an integral crimp barrel 18 at one end that is crimped with several corrugations around the end of the jacket of the ignition cable 12 so as to make electrical contact with the conductive core of the ignition cable 12 in a well known manner that is illustrated in the Bungo et al. '924 patent discussed above. Sleeve 16 has an intermediate compression ring portion 20 and a lead-in or cam portion 21 that converges in an upward direction, that is, in a direction toward compression ring portion 20 as shown more clearly in FIG. 2. An inwardly directed stop ring 22 of reduced diameter is at the lower end of sleeve 16 below cam portion 21.

Figure 4:
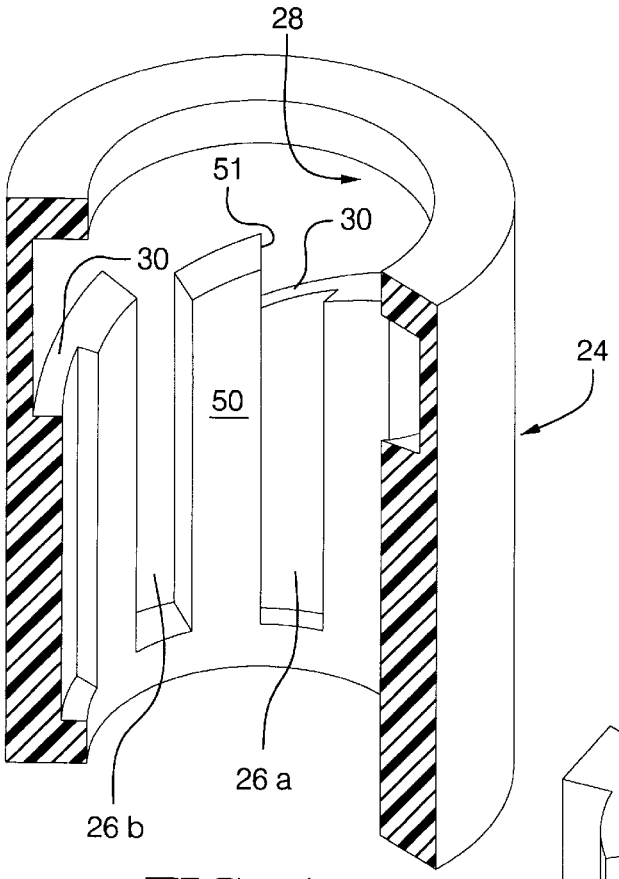
FIG. 4 is a sectioned perspective view of a lock sleeve forming part of the ignition cable assembly of FIG. 1.

A lock sleeve 24 is disposed inside metal sleeve 16 against an internal shoulder at the top of compression ring 20. Lock sleeve 24 which is shown in detail in FIG. 4 has a plurality of longitudinal channels 26 that are equally circumferentially spaced around an inner cylindrical surface. Two types of channels 26 communicate with an annular cavity 28 at an upper end of lock sleeve 24. Every other channel 26 is a lock channel 26A. Lock channels 26A are shallower than annular cavity 28 and terminate in slanted stop ridges 30 at the upper end. Release channels 26B are disposed between the lock channels 26A. Release channels 26B are deeper than lock channels 26A and preferably have the same depth as annular cavity 28. In the particular example shown, lock sleeve 24 has eight (8) equally spaced channels—four lock channels 26A and four release channels 26B. Any number of channels may be used. However, it is preferable to use an even number of channels 26 with alternating lock channels 26A and release channels 26B. Lock sleeve 24 is preferably of molded plastic construction for economical manufacture. However, other materials may be used.

Figure 5:
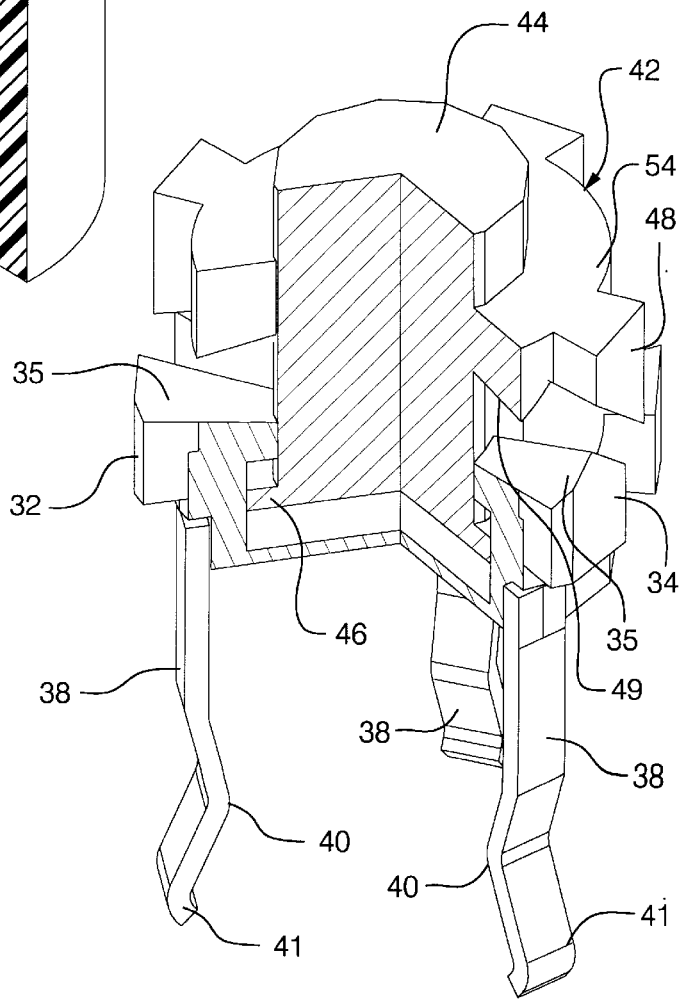
FIG. 5 is a perspective view of the top and bottom gears forming part of the ignition cable terminal assembly shown in FIG. 1.

Ignition cable terminal assembly 10 further includes a lower ring gear 32 that is shown in detail in FIG. 5. Ring gear 32 is hollow and has eight equally spaced radial teeth 34 that are disposed in the eight channels 26A, 26B of sleeve 24. Radial teeth 34, lock channels 26A and release channels 26B are all substantially equal in width so that ring gear 32 slides but does not rotate in lock sleeve 24. Ring gear 32 has a corrugated upper surface comprising a series of eight triangular ramps 35 and a flat bottom for engaging the top of the stud terminal 15 of spark plug 14. Three circumferentially spaced, metal contact arms 38 are attached to ring gear 32 at their upper ends and extend downwardly below the bottom of ring gear 32 in cantilever fashion for establishing an electrical connection between metal sleeve 16 and the stud terminal 15 of spark plug 14. Lower ring gear 32 is preferably made from a molded high temperature plastic with the upper ends of metal contact arms 38 insert molded in the ring gear 32.

Figure 2:
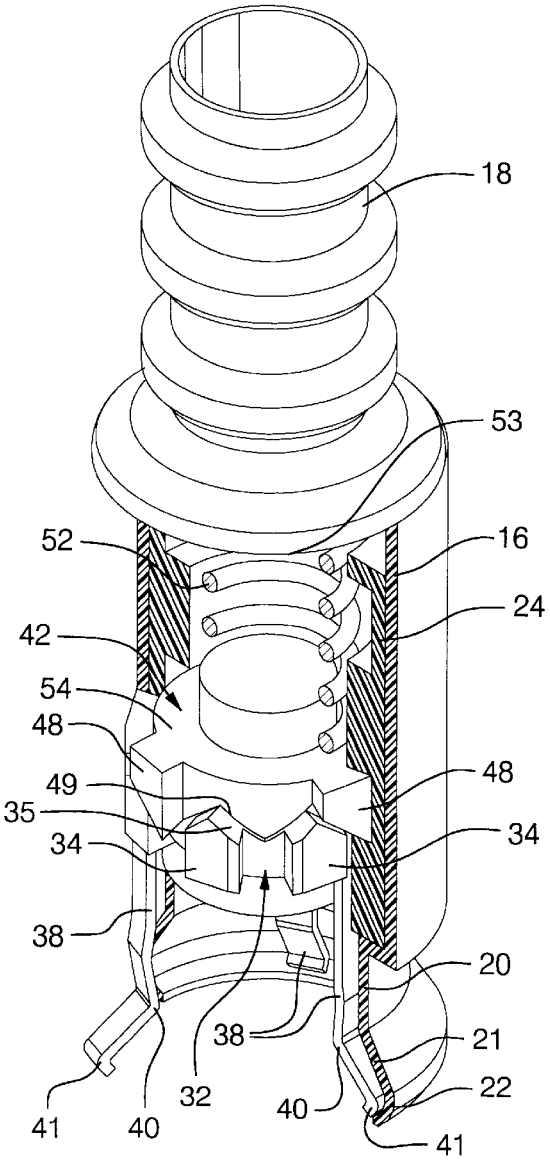
FIG. 2 is an enlargement of a portion of FIG. 1 showing the ignition cable terminal assembly disconnected from the stud terminal in the unlocked position.

Metal contact arms 38 are resilient and have medial contact portions 40 that bow inwardly and curved tips 41 at their free ends. Tips 41 engage the stop ring 22 of terminal sleeve 16 when the lower ring gear 32 in a lower unlocked position in lock sleeve 24 as best shown in FIG. 2. Metal contact arms 38 are preferably unstressed in this unlocked position.

An upper ring gear 42 which is also preferably made from a molded high temperature plastic and is also inside lock sleeve 24 above lower ring gear 32. Ring gear 42 which is also shown in detail in FIG. 5 has an axle 44 with a retainer flange 46 at the lower end. Axle 44 extends into the lower hollow ring gear 32 with retainer flange 46 trapped in the lower hollow ring gear 32 to limit movement of the two ring gears relative to each other in the longitudinal direction.

Figure 3:
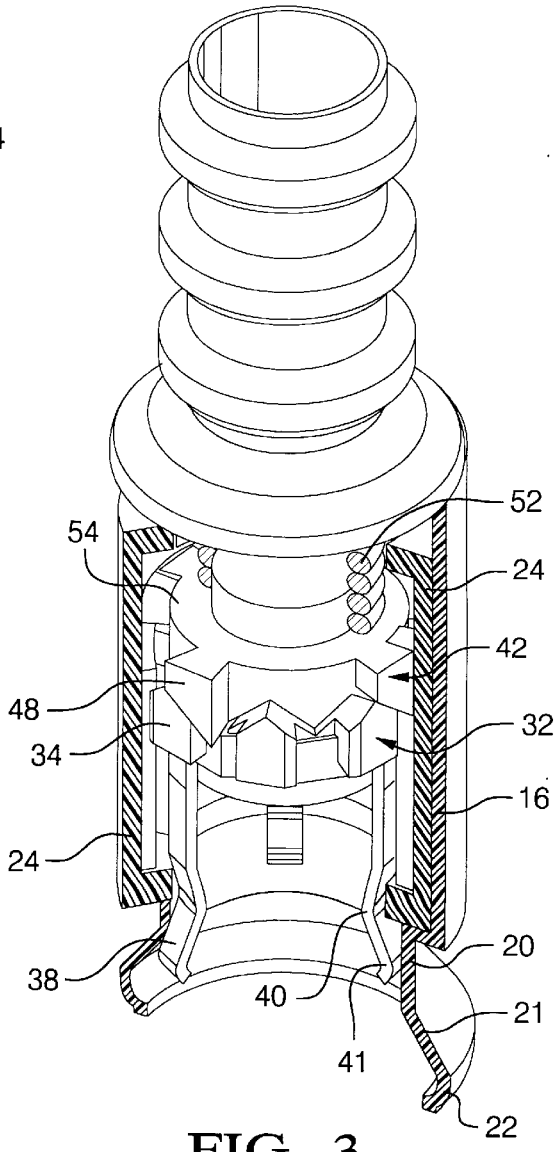
FIG. 3 is an enlargement of a portion of FIG. 1 showing the ignition cable terminal assembly disconnected from the stud terminal in the locked position.

Upper ring gear 42 has four equally spaced radial teeth 48 that are disposed in release channels 26B when terminal assembly 10 is disconnected from stud terminal 15 and in the locked position. FIG. 3 shows the locked position but the stud terminal 15 is not shown for clarity. In the locked position, teeth 48 are disposed above lock channels 26A. Teeth 48 project radially outwardly of teeth 34 and fit in release channels 26B but not in locking channels 26A. Upper ring gear 42 has a corrugated lower surface comprising a series of eight triangular ramps 49 that engage and mesh with triangular ramps 35 of lower ring gear 32.

Ignition cable terminal assembly 10 also includes a compression coil spring 52 that is inside the upper end of lock sleeve 24 as best shown in FIG. 2. Spring 52 abuts an internal reaction surface 53 of metal sleeve 16 at one end and engages an upper annular shoulder 54 of upper ring gear 42 at the other end to bias upper ring gear 42 downwardly against lower ring gear 32.

Ignition cable terminal assembly 10 operates in the following manner. The internal parts of the ignition cable terminal assembly 10 are initially in an open unlocked position shown in FIGS. 1 and 2. In this position metal contact arms 38 define a contractible socket for receiving stud terminal 15. Radial teeth 34 are slideably positioned in channels 26A and 26B and radial teeth 48 are slideably positioned in release channels 26B above teeth 34 so that coil spring 52 pushes upper ring gear 42 down which in turn pushes lower ring gear 32 down with the tips 41 of contact arms 38 engaging lip 22 of terminal sleeve 16.

The open terminal assembly 10 is inserted onto spark plug 14 and then pushed down onto stud terminal 15 until the bottom of lower ring gear 32 engages the top of the stud terminal 15 as shown in FIG. 1. Terminal assembly 10 is then pushed down against the top of stud terminal 15 causing lower and upper ring gears 32 and 42 and metal contact arms 38 to rise in lock sleeve 24 and terminal sleeve 16 against the bias of coil spring 52. As metal contact arms 38 rise, the curved tips 41 are cammed inwardly by cam portion 21 and locked by compression ring portion 20 of metal terminal sleeve 16 as shown in FIG. 3. This locks contact portion 40 in a tight engagement with stud terminal 15 under the self-biasing forces of the resilient contact arms 38.

As upper ring gear 42 is pushed upwardly by lower ring gear 32, the meshing triangular ramps 35 and 49 apply an indexing or twisting force to upper ring gear 42. This results in relative rotation or indexing of the upper ring gear 42 in the counterclockwise direction when radial teeth 48 of upper ring gear 42 reach the annular cavity 28 at the upper end of lock sleeve 24 and clear release channels 26A. As upper ring gear 42 indexes, radial teeth 48 ride over the top of the lands 50 between the channels 26A and 26B and snap down into the locking portions of the annular cavity 28 where the wedge shaped lower portions of radial teeth 48 engage lock ridges 30 and the back sides 51 of lands 50 under the bias of coil spring 52. This results in metal contact arms 38 being locked in the closed position and produces a very tight, motion-free engagement of the terminal assembly 10 with stud terminal 15. The terminal assembly 10 is plugged onto the spark plug 14 and locked onto the stud terminal 15 with a relatively low engagement force. Moreover, the terminal assembly 10 produces an audible click when radial teeth 48 are snapped down against lock ridges 30 and land sides 51 by coil spring 52 signaling the user of a successful connection.

Ignition cable terminal assembly 10 may also be disconnected from stud terminal 15 with ease. In this case, terminal assembly 10 is initially pushed down against the action of coil spring 52, causing upper ring gear 42 to rise in cavity 28 and rotate counterclockwise until radial teeth 48 disengage from lock ridges 30 and align with release channels 26B. In this regard, it should be noted that radial teeth 48 have advanced one release channel.

Coil spring 52 then pushes ring gears 32 and 42 downwardly in lock sleeve 24 to the open position shown in FIGS. 1 and 2 where metal contact arms 38 spread apart under their self-biasing spring force. This expands the contractible socket formed by metal contact arms 38 and releases stud terminal 15 so that terminal assembly 10 can be pulled off stud terminal 15 easily.

While three resilient metal contact arms have been illustrated, three contact arms is the preferred minimum and a greater number may be utilized. Similarly the number of teeth 32 and 42 and channels 26A and 26B can be varied from the numbers illustrated. However for efficiency, equal numbers of lock, channels, release channels and radial lock teeth 48 should be used.

Obviously, many modifications and variations of the present invention in light of the above teachings may be made. It is, therefore, to be understood that, within the scope of the appended claims, the invention may be practiced otherwise than as specifically described.

We claim:

1. An ignition cable terminal assembly for providing an electrical interconnection between an ignition cable and a stud terminal of a spark plug comprising:

a metal sleeve having an ignition cable connector at an upward end, an intermediate compression ring, a lead-in below the compression ring that converges in an upward direction, and an inwardly directed stop ring below the lead-in, a lock sleeve inside the metal sleeve, the lock sleeve having a plurality of circumferentially spaced longitudinal channels in an inner cylindrical surface that communicate with an annular cavity above the channels, the longitudinal channels comprising lock channels and release channels, the annular cavity having locking portions at an upper end of the lock channels, a lower annular ring gear having a downwardly facing stop surface for engaging the top of a stud terminal of a spark plug or the like and radial teeth that are slideably mounted in the channels of the lock sleeve, the lower ring gear carrying a plurality of circumferentially spaced, resilient contact arms that extend below the stop surface for establishing an electrical connection between the metal sleeve and the stud terminal of the spark plug, the resilient contact arms having intermediate contact portions that bow inwardly and curved tips at their free ends that engage the stop ring of the terminal sleeve when the lower ring gear is a lower position with respect to the lock sleeve, an upper ring gear that slides and indexes in the lock sleeve, the upper ring gear having radial teeth fit in the release channels in one position and that engage the locking portions of the annular cavity in another position, the upper and lower ring gears having meshing ramps for indexing the upper ring gear with respect to the lower ring gear, and a spring biasing the upper and lower ring gears downwardly.

2. The ignition cable terminal assembly as defined in claim 1 wherein the lock channels and the release channels are alternated.

3. The ignition cable terminal assembly as defined in claim 1 having an equal number of lock channels, release channels and radial teeth on the upper ring gear.

4. The ignition cable terminal assembly as defined in claim 1 wherein the release channels are deeper than the lock channels and the radial teeth of the upper ring gear extend radially outward of the radial teeth of the lower ring gear.

5. The ignition cable terminal assembly as defined in claim 1 wherein the locking portions of the annular cavity of the lock sleeve are wedge shaped portions partly defined by lock ridges at the upper ends of the lock channels and the radial teeth of the upper ring gear have wedge shaped portions that engage in the wedge shaped portions of the annular cavity in the said another position.

6. The ignition cable terminal assembly as defined in claim 1 wherein the upper ring gear has a number of teeth and the lower ring gear has twice the number of teeth.

7. The ignition cable terminal assembly as defined in claim 1 wherein the upper ring gear and the lower ring gear are coupled for limited movement with respect to each other in the longitudinal direction.

8. An ignition cable terminal assembly for providing an electrical interconnection between an ignition cable and a stud terminal of a spark plug comprising:

a metal sleeve having an ignition cable connector at an upward end, an intermediate compression ring, a lead-in below the compression ring that converges in an upward direction, and an inwardly directed stop ring below the lead-in, a lock sleeve inside the metal sleeve, the lock sleeve having a plurality of circumferentially spaced longitudinal channels in an inner cylindrical surface that communicate with an annular cavity above the channels, the longitudinal channels consisting of alternating lock channels and release channels, the annular cavity having wedge shaped locking portions partly defined by lock ridges at the upper ends of the lock channels, a lower annular ring gear having a downwardly facing stop surface for engaging the top of a stud terminal of a spark plug or the like and radial teeth that are slideably mounted in the channels of the lock sleeve, the lower ring gear carrying a plurality of circumferentially spaced, cantilevered, resilient contact arms that extend below the stop surface that form a contractible socket and establish an electrical connection between the metal sleeve and the stud terminal of the spark plug, the metal contact arms having intermediate contact portions that bow inwardly and curved tips at their free ends that engage the stop ring of the terminal sleeve when the lower ring gear is in a lower position with respect to the lock sleeve, an upper ring gear that slides and indexes in the lock sleeve, the upper ring gear having radial teeth fit in the release channels when the lower ring gear is in the lower position and that engage the locking portions of the annular cavity when the lower ring gear is in an upper position, the upper and lower ring gears having meshing ramps for indexing the upper ring gear so that the radial teeth of the upper ring gear engage the locking portions of the annular cavity when the lower ring gear is in the upper position, and a spring biasing the upper and lower ring gears downwardly.

9. An ignition cable terminal assembly for providing an electrical interconnection between an ignition cable and a stud terminal of a spark plug comprising:

a conductive sleeve having an ignition cable connector at an upward end, an intermediate compression ring, a lead-in below the compression ring that converges in an upward direction, and an inwardly directed stop ring below the lead-in, a lock sleeve inside the conductive sleeve, the lock sleeve having a longitudinal lock channel and a circumferentially spaced "longitudinal release channel in an inner cylindrical surface that communicate with a cavity above the channels, the cavity having a locking portion at an upper end of the lock channel, a lower annular ring gear having a downwardly facing stop surface for engaging the top of a stud terminal of a spark plug or the like and a radial tooth that is slideably mounted in the locking portion of the lock sleeve, the lower ring gear carrying a plurality of circumferentially spaced, resilient contact arms that extend below the stop surface for establishing an electrical connection between the metal sleeve and the stud terminal of the spark plug, the resilient contact arms having intermediate contact portions that bow inwardly and curved tips at their free ends that engage the stop ring of the terminal sleeve when the lower ring gear is in a lower position with respect to the lock sleeve, an upper ring gear that slides and indexes in the lock sleeve, the upper ring gear having a radial tooth in the release channel in one position and that engages the locking portion of the cavity in another position, the upper and lower ring gears having meshing portions for indexing the upper ring gear with respect to the lower ring gear, and a spring biasing the upper and lower ring gears downwardly.

* * * * *